US012760605B2

(12) United States Patent
Al-Ramadhan

(10) Patent No.: US 12,760,605 B2
(45) Date of Patent: Oct. 13, 2026

(54) EXPANDABLE DRILL PIPE CENTRALIZER/STABILIZER

(71) Applicant: Saudi Arabian Oil Company, Dhahran (SA)

(72) Inventor: Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 163 days.

(21) Appl. No.: 18/438,913

(22) Filed: Feb. 12, 2024

(65) Prior Publication Data

US 2024/0183230 A1 Jun. 6, 2024

Related U.S. Application Data

(62) Division of application No. 17/893,737, filed on Aug. 23, 2022, now Pat. No. 11,933,113.

(51) Int. Cl.
*E21B 17/10* (2006.01)

(52) U.S. Cl.
CPC ..... *E21B 17/1021* (2013.01)

(58) Field of Classification Search
CPC ..... E21B 17/1021
USPC ..... 166/241.1
See application file for complete search history.

(56) References Cited

U.S. PATENT DOCUMENTS

| | | | | |
|---|---|---|---|---|
| 2,891,769 | A * | 6/1959 | Page, Sr. | E21B 17/1014 175/76 |
| 2,973,996 | A | 3/1961 | Self | |
| 3,545,825 | A | 12/1970 | Hamilton | |
| 4,960,173 | A | 10/1990 | Cognevich | |
| 5,655,609 | A * | 8/1997 | Brown | E21B 17/1021 175/325.1 |
| 5,758,723 | A * | 6/1998 | Saucier | E21B 17/1021 166/241.6 |
| 10,865,606 | B2 * | 12/2020 | Massey | E21B 17/1057 |
| 10,988,991 | B1 | 4/2021 | McCormick | |
| 11,933,113 | B1 | 3/2024 | Al-Ramadhan | |
| 2009/0159269 | A1 * | 6/2009 | Sheiretov | E21B 23/14 166/241.1 |
| 2018/0010407 | A1 | 1/2018 | Jaaskelainen | |
| 2021/0381322 | A1 | 12/2021 | Roessler | |
| 2024/0068305 | A1 | 2/2024 | Al-Ramadhan | |

* cited by examiner

*Primary Examiner* — Tara Schimpf
*Assistant Examiner* — Patrick F Lambe
(74) *Attorney, Agent, or Firm* — Fish & Richardson P.C.

(57) ABSTRACT

The centralizer also includes a body defining a central bore and a plurality of cavities fluidically coupled to the central bore and an exterior of the body, where the plurality of cavities are located between the central bore and an outer surface of the body. The centralizer also includes a plurality of springs with each housed in one of the plurality of cavities. The centralizer also includes a plurality of pistons with each housed in one of the plurality of cavities and abutting a respective spring in that cavity. The centralizer also includes a centralizer pad pivotally connected to each of the plurality of pistons and extending radially from a longitudinal axis of the body in response to bias from the plurality of springs.

7 Claims, 3 Drawing Sheets

EXPANDABLE DRILL PIPE CENTRALIZER/STABILIZER

CROSS REFERENCE TO RELATED PATENT APPLICATIONS

This application is a divisional of and claims the benefit of priority to U.S. application Ser. No. 17/893,737 filed on Aug. 23, 2022, the contents of which are incorporated by reference herein.

FIELD OF INVENTION

The document relates to centralizers and stabilizer and, more specifically, expandable drill-pipe centralizers/stabilizers.

BACKGROUND

During drilling or well intervention including drill pipes across an open hole, the drill pipe can become differentially stuck against the formation due to high over balance. Differentially stuck incidents can result in costly fishing operations and/or could result in wellbore abandonment and sidetracks. In order to avoid these issues, full gauged stabilizers/centralizers can be used to centralize and/or stabilize the drill pipe and are typically rigid.

SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a centralizer. The centralizer also includes a body defining a central bore and a plurality of cavities fluidically coupled to the central bore and an exterior of the body, where the plurality of cavities are located between the central bore and an outer surface of the body. The centralizer also includes a plurality of springs with each housed in one of the plurality of cavities. The centralizer also includes a plurality of pistons with each housed in one of the plurality of cavities and abutting a respective spring in that cavity. The centralizer also includes a centralizer pad pivotally connected to each of the plurality of pistons and extending radially from a longitudinal axis of the body in response to bias from the plurality of springs. Other embodiments of this aspect include corresponding computer systems, apparatus, and computer programs recorded on one or more computer storage devices, each configured to perform the actions of the methods.

Implementations may include one or more of the following features. The centralizer where the plurality of cavities may include a downhole cavity and an uphole cavity, the plurality of springs may include a downhole spring housed in the downhole cavity and an uphole spring housed in the uphole cavity. The plurality of pistons may include a downhole piston with a downhole surface abutting an uphold end of the downhole spring and an uphole piston with a downhole surface abutting an uphole end of the uphole spring. The body further defines a slot radially offset from the central bore and between the downhole cavity and the uphole cavity and having an opening to an exterior of the body. The body further defines downhole rod passage between the downhole cavity and the slot and an uphole rod passage between the uphole cavity and the slot, the centralizer may include: a downhole sliding rod with a downhole end connected to an uphole surface of the uphole piston and an uphole end extending through the downhole rod passage into the slot and pivotally connected to the centralizer pad; and an uphole connect rod with an uphole end connected to a downhole surface of the uphole piston and a downhole end extending through the uphole rod passage into the slot and pivotally connected to the centralizer pad. The downhole sliding rod includes at least a portion extending into the slot; an uphole piston including an uphole housed in the uphole cavity and having an uphole end abutting a downhole end of the uphole spring; Implementations of the described techniques may include hardware, a method or process, or computer software on a computer-accessible medium.

One general aspect includes a centralizer. The centralizer also includes a body defining a central bore, a plurality of cavities between an outer surface of the body and the central bore, a plurality of slots having an opening to the exterior of the body and radially offset from the central bore, where the body further defines exterior ports between the plurality of cavities and the central bore, interior ports between the plurality of cavities and an exterior of the body, and rod ports extending at least longitudinally between the plurality of cavities and one of the plurality of slots. The centralizer also includes a plurality of springs with each housed in one of the plurality of the cavities and having a downhole end abutting a downhole end of that cavity. The centralizer also includes a plurality of pistons with each housed in one of the plurality of cavities and having a downhole surface abutting an uphole end of the spring in that cavity. The centralizer also includes a plurality of sliding rods with each having a downhole end connected to a back surface of one of the plurality of pistons, where each of the plurality of sliding rods has a portion extending through one of the rod ports into one of the plurality of slots. The centralizer also includes a plurality of expansion beams having a first end pivotally connected to a second end of one of the plurality of connecting and a second end pivotally connected to one of a plurality of centralizer pads. The centralizer also includes the plurality of centralizer having an outer surface. Other embodiments of this aspect include corresponding computer systems, apparatus, and computer programs recorded on one or more computer storage devices, each configured to perform the actions of the methods.

One general aspect includes a method. The method also includes selectively positioning a centralizer in a well bore while pump operations are ceased. The method also includes pumping drilling mud through a drill string to retract centralizer pads of the centralizer. The method also includes adjusting the drill string while the drilling mud is pumped. The method also includes ceasing pumping of the drilling mud to expand the centralizer pads. Other embodiments of this aspect include corresponding computer systems, apparatus, and computer programs recorded on one or more computer storage devices, each configured to perform the actions of the methods.

In some instances, the disclosure describes an apparatus and procedure for using expandable drill pipe centralizers or stabilizers for oil and gas wells to avoid, minimize, or otherwise reduce differentially stuck pipe incidents while having stationary pipe in the open hole.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
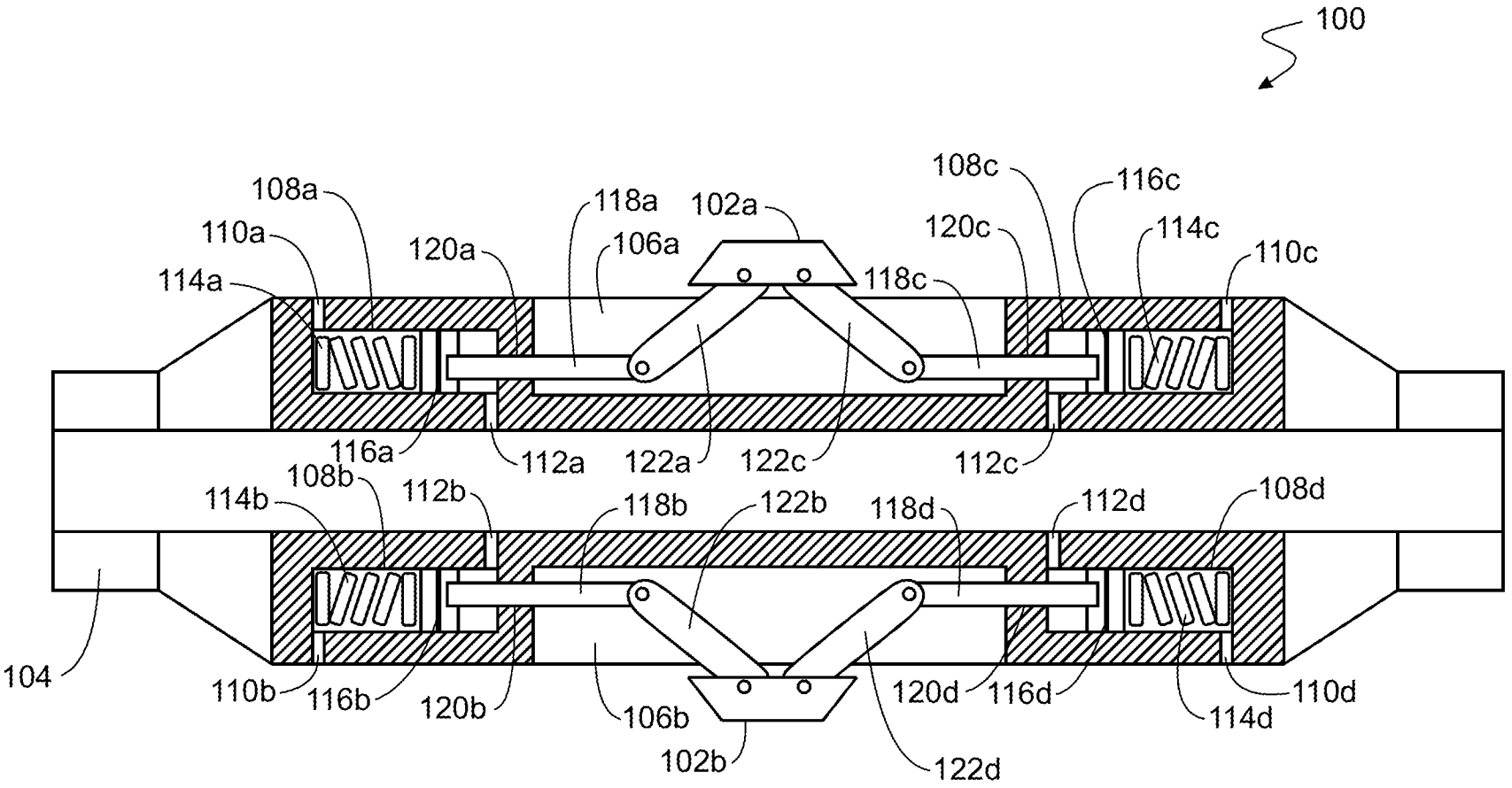
FIG. 1 is an expanded centralizer in accordance with some implementations of the present disclosure.

FIG. 1 illustrates an expandable drill-pipe centralizer 100 in accordance with some implementations of the present disclosure. For example, the expandable drill-pipe centralizer 100 can be used in oil and gas wells to avoid, minimize, or reduce differentially stuck pipe incidents while having a stationary pipe in an open hole. As illustrated, the expandable drill-pipe centralizer 100 includes one or more centralizer pads 102*a-b* that extend from a drill pipe 104 or retract into slots 106*a-b* in the drill pipe 104. In some instances, the centralizer pads 102 extend radially, longitudinally, or a combination of motions to extend out of the slots 106*a-b* of the drill pipe 104 to contact a wellbore inner diameter (ID). For example, the centralizer pads 102 can be expandable, low friction pads that are activated to provide stand off from the wellbore ID during static conditions. The pads can be carbon steel with the pad face coated with high erosion resistance and low friction material like Teflon or Ceramic material. In these instances, the low friction materials can be attached to the pad in form or distributed inserts instead of coating.

The drill pipe 104 defines cavities 108*a-d* having external ports 110*a-d* and internal ports 112*a-d*. The cavities 108*a-d* can be cylindrical and parallel to a longitudinal axis of the drill pipe 104. The cavities 108-*a-d* can be other shapes, orientations, or a combination thereof, without departing from the scope of the disclosure. As illustrated, the cavities 108*a-d* can include a downhole end and an uphole end. The slot 106*a* is located between the cavities 108*a* and 108*c*, and the slot 106*b* is located between the cavities 108*b* and 108*d*. The external ports 110*a-d* fluidically connect the cavities 108*a-d* with the wellbore external to the drill pipe 104. The internal ports 112*a-d* fluidically connect the cavities 108*a-d* to the central bore of the drill pipe 104.

In the illustrated implementation, the cavities 108*a-d* can include springs 114*a-d* that are directly or indirectly connected to the centralizer pads 102 and extend the centralizer pads 102 radially from the drill pipe 104 when not activated. The springs 114*a-d* can include a longitudinal axis parallel with the longitudinal axis of the cavities 108*a-d*. As illustrated, the springs 114*a-d* have downhole ends and uphole ends. The downhole ends of the springs 114*a* and 114*b* can abut the downhole ends of the cavities 108*a* and 108*b*, and uphole ends of the springs 114*a* and 114*b* can abut a downhole surface of pistons 116*a* and 116*b*. The uphole ends of the springs 114*c* and 114*d* can abut the uphole ends of the cavities 108*c* and 108*d*, and the downhole ends of the springs 114*c* and 114*d* can abut an uphole surface of pistons 116*c* and 116*d*. While the drill-pipe centralizer 100 includes springs 114*a-d*, other resilient devices or materials may be used alternatively or in combination with the springs 114*a-d* without departing from the scope of the disclosure. For example, the cavities 108*a-d* can be filled with compressed air to a predetermined pressure with the external ports 110*a-d* and locked with a pin. During pumping in this example, the air will be compressed by the hydraulic pressure inside the pipe through the internal ports 112*a-d* pushing the pistons 116*a-d* against the air, resulting in the retraction of the pads.

The cavities 108*a-d* include pistons 116*a-d* with each having a front surface abutting the springs 114*a-d* and a back attached to sliding rods 118*a-d*. For example, the pistons 116*a* and 116*b* have a downhole surface abutting the uphole end of springs 114*a* and 114*b*. Also, the pistons 116*c* and 116*d* have an uphole surface that abuts a downhole end of the springs 114*c* and 114*d*. The pistons 116*a-d* and the sliding rods 118*a-d* can slide along the longitudinal axis of the cavities 108*a-d*. The pistons 116*a-d* and the sliding rods 118*a-d* can have an angle (e.g., acute angle) relative to the longitudinal axis of the cavities 108*a-d* without departing from the scope of the disclosure. The cavities 108*a-d* include openings 120*a-d* and a portion of the sliding rod 118*a-d* extends outside of the cavities 108*a-d* into one of the slots 106*a* and 106*b*. The sliding rods 118*a-d* are rotatably attached to one end of expansion beams 122*a-d*. For example, the sliding rods 118*a-d* can be connected to the expansion beams 122*a-d* using a pivot. As illustrated, the uphole ends of the sliding rods 118*a* and 118*b* are pivotally connected to the downhole ends of the expansion beams 122*a* and 122*b*. The downhole ends of the sliding rods 118*c* and 118*d* are pivotally connected to the uphole end of the expansion beams 122*c* and 122*d*. An opposite end of the expansion beams 122*a-d* is rotatably connected to the centralized pads 102*a-b*. The expansion beams 122*a-d* can be connected to the centralized pads 102*a-b* using a pivot. The uphole end of the expansion beams 122*a* and 122*b* are pivotally connected to the downhole end of the centralized pads 102*a* and 102*b*, and the downhole ends of the expansion beams 122*c* and 122*d* are pivotally connected to the uphole end of the centralizer pads 102*a* and 102*b*.

In some aspects of operation, the springs 114*a-d* apply pressure to the abutting surface of the pistons 116*a-d* and, in response, the sliding rods 118*a-d* are moved laterally. The expansion beams 122*a-d* rotate away from the longitudinal axis of the drill pipe 104 and move the centralized pads 102*a-b* outside the slots 106*a-b*. In these instances, the centralizer pads 102 can contact the inner diameter of a wellbore to centralize or otherwise stabilize the drill pipe 104 in that wellbore.

Figure 2:
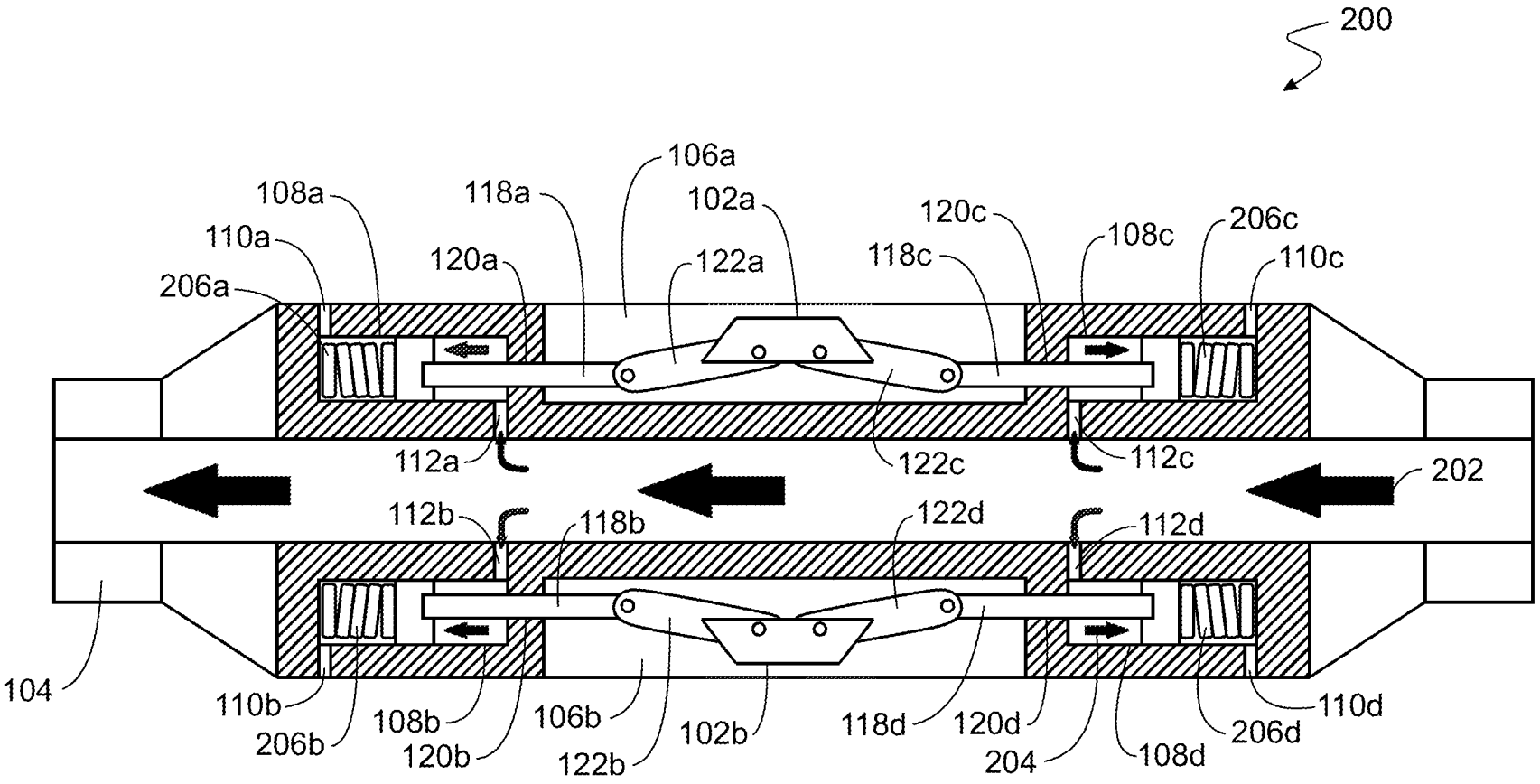
FIG. 2 is a retracted centralizer in accordance with some implementations of the present disclosure.
Figure 3:
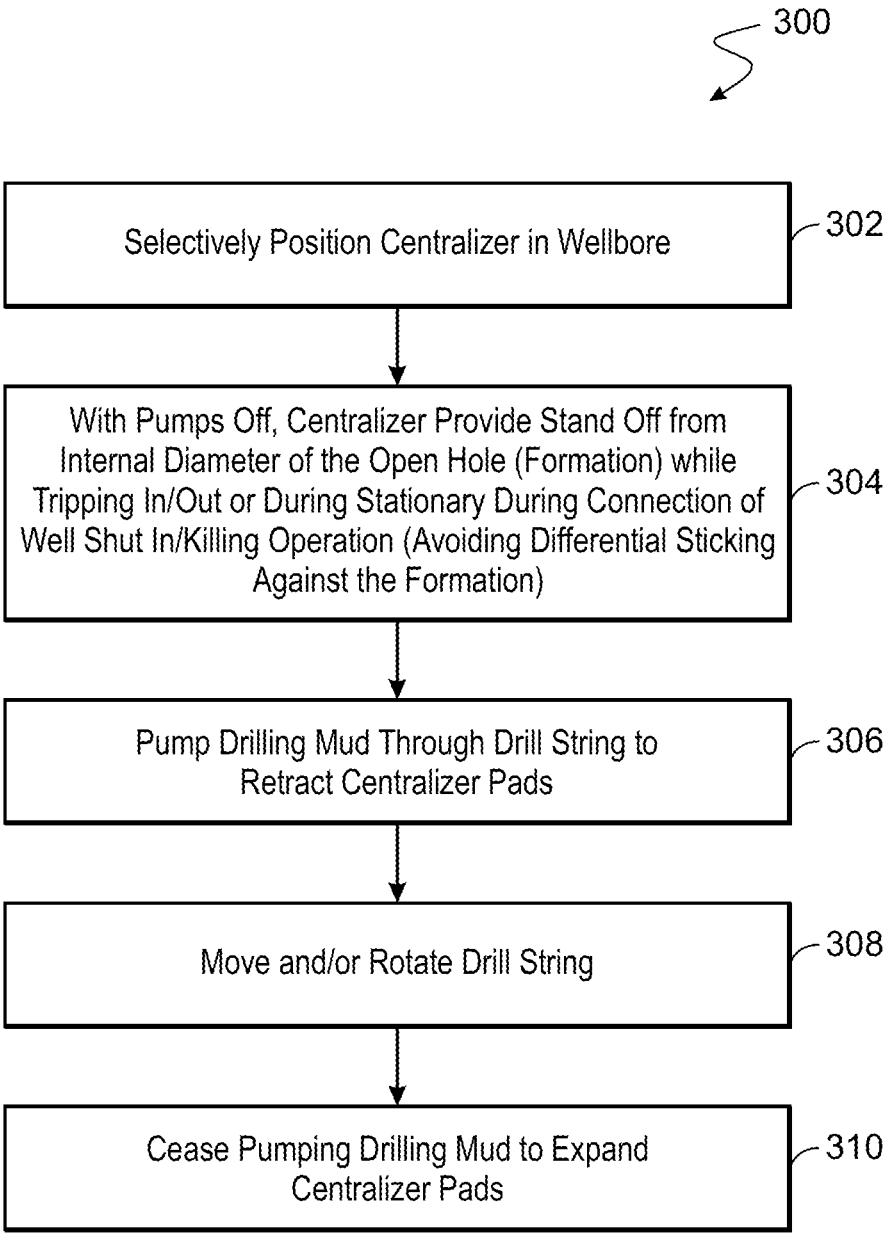
FIG. 3 is a flowchart illustrating an example method for retracting a centralizer in accordance with some implementations of the present disclosure.

FIG. 2 illustrates the expandable drill-pipe centralizer 100 in a retracted configuration formed in response to internal fluid 202. In particular, the internal fluid 202 enters the cavities 108*a-d* through the internal ports 112*a-d*. The internal fluid 202 then applies a pressure 204 to a back surface to the pistons 116*a-d*. The external ports 110*a-d* enable fluid to exit outside the drill pipe 104 and prevent pressure lockup (equalizes to the pressure outside of the pipe 104) the front surface of the pistons 116*a-d*. If the differential pressure between the back surface and front surface of the pistons 116*a-d* is above a predefined threshold, the pistons 116*a-d* compress the springs 114*a-d* form a compressed configuration 206*a-d*. The centralizer pads 102*a-b* retract in response to compression of the springs 114*a-d*. If differential pressure is above a retraction threshold, the centralizer pads 102*a-b* retract into the slots 106*a-b*. The retraction threshold can be based on one or more properties of the springs 114*a-d*, such as spring load:

FIG. 3 is a flow chart of another example method 300 of adjusting centralizer pads when a drill pipe is differentially stuck according to the implementations of the present disclosure. Example method 300 determines a differentially stuck pipe using the drill-pipe centralizer 100.

At step 302, a centralizer is selectively positioned in a wellbore. For example, the drill pipe 104 of FIG. 1 may be inserted into a wellbore and distributed over the length of the planned open hole drilling interval and the centralizer pads 102*a-b* can expand and contract as the drill pipe moves through the wellbore (e.g. tripping in or out) or kept stationary (e.g. while making up of breaking drill pipe connection or shutting in the BOP to control well flow) without pumping.

At step 304, with pumps off, centralizer pads 102*a-b* are expanded and com in contact with the internal diameter of the open hole (small contact area) to provide stand off for the rest of the drill string from internal diameter of the open hole large contact area) while tripping in/out or during stationary during connection of well shut in/killing operation with low pump rate/pressure (avoiding differential sticking of the drill string against the formation).

At step 306, drilling mud is pumped through the drill string 104 to retract the centralizer pads. As illustrated in FIG. 2, the fluid 202 is pumped through the interior of the drill string 104 and into the internal ports 112*a-d* with high pumping rate/pressure. In response to the fluidic pressure, the pistons 116*a-d* contract the springs 114*a-d*. The expansion beams 122*a-d* rotate and retract the centralizer pads 102*a-b* into the slots 106*a-b*.

At step 308, the drill string is rotated and/or moved in the wellbore. In FIG. 2, once the centralizer pads 102*a-d* are at least retracted partially into the slots 106*a-b*, the drill pipe 104 can be rotated and/or moved beyond an obstruction.

At step 310, pumping of the drilling mud is ceased to expand the centralizer pads. In the illustrated examples, the drilling mud 202 is ceased or the pressure is otherwise reduced such that the springs 114*a-d* expand and extend the centralized pads 102 from the slots 106*a-b*.

Like reference symbols in the various drawings indicate like elements.

A number of embodiments of the invention have been described. Nevertheless, it will be understood that various modifications may be made without departing from the spirit and scope of the invention. Accordingly, other embodiments are within the scope of the following claims.

What is claimed is:

1. A method, comprising:

selectively positioning a centralizer in a well bore while pump operations are ceased, wherein the centralizer comprises a body, centralizer pads, and a plurality of springs, wherein the body defines a central bore and a plurality of cavities fluidically coupled to the central bore and an exterior of the body, wherein the plurality of cavities are located between the central bore and an outer surface of the body and comprise a downhole cavity and an uphole cavity and wherein the plurality of springs comprise a downhole spring housed in the downhole cavity and an uphole spring housed in the uphole cavity, wherein while a differential pressure is below a retraction threshold, the plurality of springs apply pressure to each of a plurality of pistons pivotally connected to a centralizer pad of the centralizer pads being brought in contact with an inner diameter of the well bore to centralize a drill pipe;

retracting the centralizer pads of the centralizer by pumping drilling mud through a drill string;

adjusting the drill string while the drilling mud is pumped; and ceasing pumping of the drilling mud to expand the centralizer pads.

2. The method of claim 1, comprising:

while the differential pressure is above the retraction threshold, the plurality of pistons with each housed in one of the plurality of cavities is abutting a respective spring in each cavity of the plurality of cavities; and the centralizer pad is pivotally connected to each of the plurality of pistons and is extending radially from a longitudinal axis of the body in response to bias from the plurality of springs.

3. The method of claim 2, wherein the plurality of cavities comprises a downhole cavity and an uphole cavity, the plurality of springs comprises a downhole spring housed in the downhole cavity and an uphole spring housed in the uphole cavity.

4. The method of claim 3, wherein the plurality of pistons comprises a downhole piston with a downhole surface abutting an uphole end of the downhole spring and an uphole piston with a downhole surface abutting an uphole end of the uphole spring.

5. The method of claim 4, wherein the body further defines a slot radially offset from the central bore and between the downhole cavity and the uphole cavity and having an opening to an exterior of the body.

6. The method of claim 5, wherein the body further defines downhole rod passage between the downhole cavity and the slot and an uphole rod passage between the uphole cavity and the slot, the centralizer further comprising:

a downhole sliding rod with a downhole end connected to an uphole surface of the uphole piston and an uphole end extending through the downhole rod passage into the slot and pivotally connected to the centralizer pad; and an uphole connect rod with an uphole end connected to a downhole surface of the uphole piston and a downhole end extending through the uphole rod passage into the slot and pivotally connected to the centralizer pad.

7. The method of claim 6, further comprising:

a downhole expansion beam having a downhole end pivotally connected to the uphole end of the downhole sliding rod and an uphold end pivotally connected to a downhole end of the centralizer pad; and an uphole expansion beam having an uphole end pivotally connected to the downhole end of the uphole sliding rod and a downhole end pivotally connected to an uphole end of the centralizer pad.

* * * * *